US005264759A

United States Patent [19]

Lewandowski et al.

[11] Patent Number: 5,264,759

[45] Date of Patent: Nov. 23, 1993

[54] HIGH-PRESSURE, HIGH-POWER DISCHARGE LAMP, AND METHOD OF ITS MANUFACTURE

[75] Inventors: Bernd Lewandowski; Dieter Franke; Walter Kiele, all of Munich, Fed. Rep. of Germany

[73] Assignee: Patent-Treuhand-Gesellschaft für elektrische Glühlampen mbH, Munich, Fed. Rep. of Germany

[21] Appl. No.: 766,005

[22] Filed: Sep. 26, 1991

[30] Foreign Application Priority Data

Oct. 2, 1990 [DE] Fed. Rep. of Germany ..... 4031116

[51] Int. Cl.[5] ..... H01J 17/18

[52] U.S. Cl. ..... 313/623; 313/43; 313/44; 313/634

[58] Field of Search ..... 313/30, 43, 44, 623, 313/332, 634; 445/1, 22, 26, 38

[56] References Cited

U.S. PATENT DOCUMENTS

| | | | |
|---|---|---|---|
| 3,675,068 | 7/1972 | Strauss | 313/623 |
| 4,647,814 | 3/1987 | Dobrusskin et al. | 313/641 |
| 4,959,587 | 9/1990 | Schug . | |

FOREIGN PATENT DOCUMENTS

| | | |
|---|---|---|
| 0115921 | 8/1984 | European Pat. Off. . |
| 1489616 | 4/1969 | Fed. Rep. of Germany . |
| 3110465 | 1/1982 | Fed. Rep. of Germany . |
| 682376 | 11/1952 | United Kingdom . |

OTHER PUBLICATIONS

Soviet Inventions Illustrated, SU 1092-608-A, Feb. 1985.

*Primary Examiner*—Donald J. Yusko
*Assistant Examiner*—N. D. Patel
*Attorney, Agent, or Firm*—Frishauf, Holtz, Goodman & Woodward

[57] ABSTRACT

To provide a high-pressure lamp capable of carrying lamp currents of 100 amperes and higher, an essentially rotation-symmetrical discharge space (2) has two cylindrical necks (3, 4) melt-sealed thereto. Each one of the necks is formed of at least two telescoped hollow cylindrical quartz glass tubes (19, 27) which, with sealing foils circumferentially located within the neck, are all gas-tightly melt-sealed together. The sealing foils, typically of molybdenum, are electrically connected to a molybdenum disk (7, 8), for example by being welded to the circumference thereof which, in turn, is soldered to an end portion of an electrode shaft (5, 6), typically of tungsten, which extends into the discharge space of the discharge vessel. During manufacture, the inner quartz glass tube (27) is formed with a ring-shaped expansion or distention (23) which is melt-sealed to the inner wall of the outer glass tube (19), to permit flushing of the space between the glass tubes and where the sealing foils are located, for example flushing with argon, and subsequent melt-sealing with a vacuum of 20 mbar argon, while introducing 1 bar air pressure into the interior of the inner tube. After the neck structure is gas-tightly sealed together, the enlargement or distention together with an adjacent portion of the neck structure, is severed.

20 Claims, 3 Drawing Sheets

HIGH-PRESSURE, HIGH-POWER DISCHARGE LAMP, AND METHOD OF ITS MANUFACTURE

Reference to related patent and applications, the disclosures of which are hereby incorporated by reference, assigned to the assignee of the present application:

U.S. Pat. No. 4,647,814, Dobrusskin et al.

U.S. Ser. No. 07/766,001, filed Sep. 26, 1991, Lewandowski et al.

U.S. Ser. No. 07/766,451, filed Sep. 26, 1991, Dixon et al.

FIELD OF THE INVENTION

The present invention relates to high-pressure discharge lamps, and more particularly to high-pressure discharge lamps of high power, having lamp currents which may exceed 100 A, for example of 130 A and even more, and to a method to make the lamp. The lamp construction and method may, of course, also be used with lamps of lower power requirements although the costs of the construction and method may not be economically justified for lower power lamps.

BACKGROUND

The high-pressure discharge lamps to which the present invention relates, and which are, for instance, shown in the referenced U.S. Pat. No. 4,647,814, Dobrusskin et al., assigned to the assignee of the present application, are particularly suitable for illumination of theater stages, television and motion picture film studios and the like. The light flux should be high and, further, have a color temperature which is similar to daylight, with a very good color rendition index. Such high-pressure discharge lamps have a discharge vessel, retaining a fill which includes a metal halide. Prior art lamps of this type provide a light flux of over one million lumens; in a typical lamp, and with an operating current of 65 A and an arc power of 12 kW, a light flux of 1.1. mega lumens can be obtained. The electrodes within the discharge vessel are rod or pin-like and retained in the discharge vessel by being melt-sealed therein, with a molybdenum sealing foil providing a current supply connection for the electrodes.

The requirements for still higher light output and higher power lamps have led to investigations of loading of the current supply connection. To obtain still higher light flux, standard melt seals permit operating currents of at the most 100 A. Higher operating currents lead to excessive heating of the melt, and the molybdenum sealing foils tend to corrode, and separate from the seal. The metal halide fill in the lamp also causes devitrification of the discharge vessel, so that the average lifetime of the lamp is short and becomes economically unsatisfactory.

Other high-pressure discharge lamps of this type having a fill consisting of mercury and a rare gas or of extra-high pressure rare gas are used specifically in the manufacture of electronic components.

THE INVENTION

It is an object to provide a high-pressure discharge lamp which has electrode melt seals which can tolerate high operating currents. These seals, further, should be simple in construction and permit ready manufacture.

Briefly, a high current carrying sealing and electrical connection arrangement is provided to seal the electrodes of the lamp to the discharge vessel. Each one of the electrodes is connected to a metal disk, for example of molybdenum, secured to each of the electrode shaft portions. At least two sealing foils, and preferably four sealing foils, typically elongated molybdenum ribbons, tapes or strips, are secured to each of the metal disks coupled to the electrodes. These sealing foils extend longitudinally within respective neck portions of the lamp, extending from the discharge vessel, and are electrically and mechanically secured to the disks, for example by welding. At least one of the necks, and preferably both, are formed as a composite neck structure built up of at least two hollow cylindrical quartz glass tubes, concentrically, telescopically fitted within each other. The at least two sealing foils are positioned between two of these quartz glass tubes. The telescopically located glass tubes, with the sealing foils therebetween, are then gas-tightly melt-sealed together, and further melt-sealed to the next tube extending from the discharge vessel itself.

In accordance with a feature of the invention, the lamp is made by first providing an essentially rotation-symmetrical quartz glass discharge vessel or bulb, formed with axially aligned openings, to which hollow quartz glass neck tube elements are melt-sealed, into which, later, the electrodes and the sealing foils are introduced, to be subsequently all melt-sealed together.

The construction of the necks for the discharge vessel in the form of at least two telescopically received hollow cylindrical quartz glass tubes, with the sealing foils interposed, and all melted together to form a gas-tight unit, provides for substantially lower current loading of the individual sealing foils than prior art lamps. Distributing the sealing foils uniformly about the circumference of the inner hollow cylindrical quartz glass tube, and extending parallel to the longitudinal axis of the lamp, that is, of the lamp neck, results in essentially uniform heating of the lamp and lamp neck, circumferentially, when the lamp is operated. Overloading and localized hot spots in the melt, due to temperature differences in the lamp neck, are thereby avoided. The metal disk, the edge of which is electrically connected to the sealing foils, and secured to the electrode shaft, ensures high stability for the entire lamp structure, including the projecting necks.

The interior of the necks is hollow. This permits a base secured to the end of the neck to be formed with an opening through which air can pass, thus providing, in operation of the lamp, for additional heat removal of the neck portion. This heat can be removed, either by air flow or, in accordance with a feature of the invention, by at least partially inserting a rod of heat-conductive material into the hollow interior of the neck, insulated from current carrying elements. Such a rod, which provides a heat sink and heat dissipation element, further enhances the cooling effect obtained by the construction.

The particular construction of the lamp necks permits operating currents well above 20 A, for example up to 120 A or 130 A, without damaging the melt connections, and thus decreasing the average lifetime of the lamp. The high currents, upon operation of the lamp at a power rating current up to 24 kW, for example, permit construction of high-pressure discharge lamps with a metal halide fill providing light flux of over 2 mega lumens.

In accordance with a feature of the invention, the lamp is made by first melt-sealing the neck tube to the actual discharge vessel and, then, providing an inner hollow cylindrical tube of quartz glass. This inner tube, in turn, can be a composite of two or more telescoped quartz glass tubes which are melt-sealed together. The inner one of the composite inner tubes is closed off at the end facing the discharge space, and, initially upon manufacture, is formed with a ring-like expansion bulge, which expands the tube in olive or barrel shape, with an outer diameter fitting within the inner diameter of the neck tube. The outer one of the composite inner tube can be open towards the discharge end of the vessel, but initially melt-sealed to the inner one of the composite tube at least at the end remote from the discharge vessel.

Constructing the inner tube as a composite of at least two tubes has the advantage that, upon later melt-sealing of the sealing foils, the melt quality can be optically checked. Good melt sealing of the foils is possible only when the quartz glass of both inner tubes is softened to such an extent that optically no outer contours of the tubes are visible any longer.

Before the hollow cylindrical inner tube, that is, preferably the composite inner tube, is introduced into the neck tube, a metal disk, with the electrode secured thereon, and the sealing foils extending therefrom, is fitted on or in the inner tube. After introduction of the subassembly of inner tube—electrode shaft and sealing foils, the outer edge of the olive or barrel shaped expansion of the inner tube is sealed to the inner wall of the outer tube. This closes off the still loose combination of outer tube—inner tube electrode subassembly, and permits repeated flushing of the discharge vessel as well as of the neck portion with the sealing foil subassembly therein, for example by argon gas, and subsequently evacuating the space between the outer and the inner tube. After evacuation, the sealing foils are then melt-sealed gas-tightly between the tubes in which they are located. Preferably, a vacuum of about 20 mbar argon is maintained in the space between the tubes which are to be sealed together. In the interior of the inner hollow cylindrial inner tube, an air pressure of 1 bar can be generated.

After all elements are melt-sealed together, the end of the neck, together with the olive-shaped expanded portion of the inner tube, is severed. The sealing foils are then connected electrically to suitable base terminal elements within a base, attached to the end of the neck.

DRAWINGS

DETAILED DESCRIPTION

Figure 1:
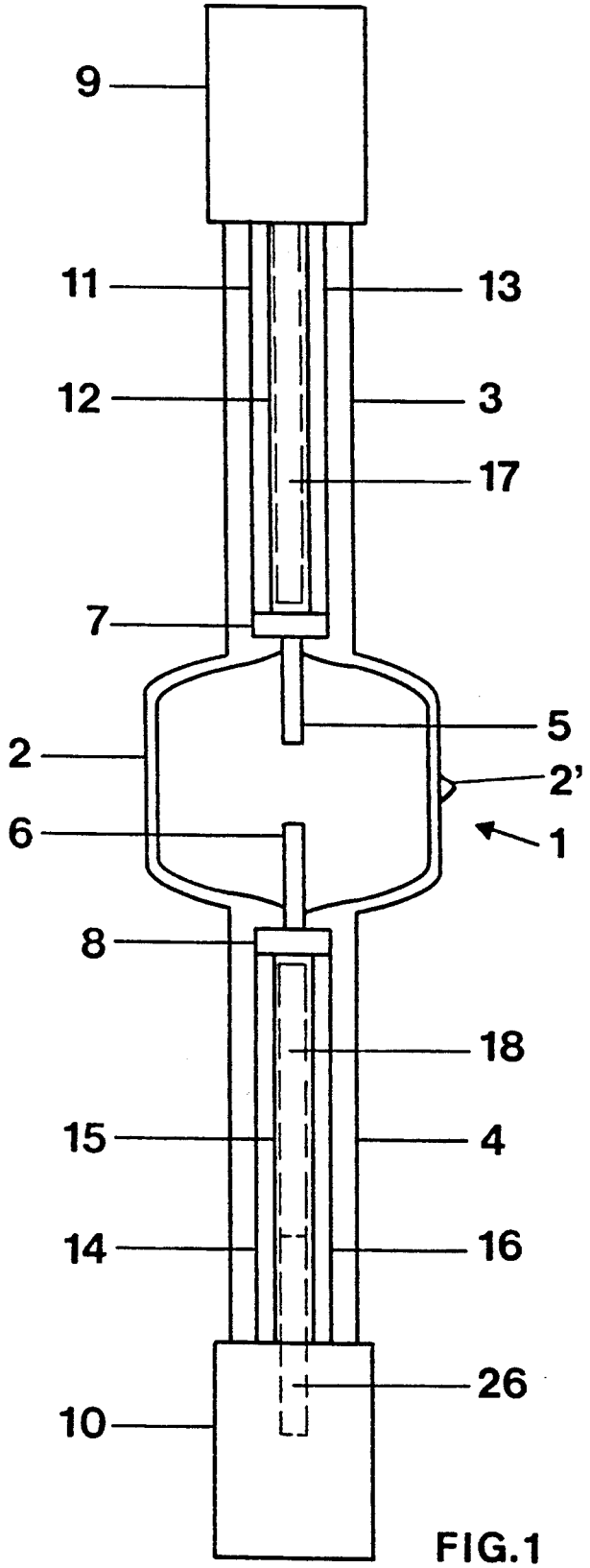
FIG. 1 is a highly schematic side view of a high-pressure discharge lamp in accordance with the present invention.

For purposes of illustration, FIG. 1 shows a high-pressure metal halide discharge lamp designed for a power rating of 24 kW. The lamp bulb 1 is made of quartz glass and defines an essentially cylindrical, rotation-symmetrical discharge vessel 2 enclosing a discharge space. Cylindrical necks 3, 4 are melt-connected to the discharge vessel 2, positioned coaxially with a vertical axis of the lamp, as seen in FIG. 1. Two rod or pin electrodes 5, 6 extend into the discharge space. They are made of tungsten.

In accordance with a feature of the invention, the rod or pin electrodes are connected to an external current supply lead by first providing a circular cylindrical disk 7, 8, made of molybdenum, to which the ends of the rod or pin electrodes 5, 6 remote from the arc are attached. The disks are formed with holes, and the rod or pin electrodes 6, 7 are soldered with platinum solder securely to the disks 7, 8, for example by soldering tight the connection of the pin electrodes in the holes of the disks 7, 8.

In accordance with a feature of the invention, the pin electrodes 5, 6 are connected to bases 9, 10 of the type s 30×70 by four ribbon, tape or strip-like molybdenum sealing foils. In FIG. 1, only three molybdenum foils for each neck are visible, namely foils 11, 12, 13 in the upper neck 3, and foils 14, 15, 16 in the lower neck 4. The bases 9, 10 are fitted on the ends of the necks 3, 4, respectively. The sealing foils 11–16 are welded to the disks 7, 8, respectively. The other ends of the sealing foils are connected to external current supply leads, not visible, and within the bases 9, 10, in a suitable manner, for example by making weld connections of supply leads thereto.

In accordance with a further feature of the invention, the sealing foils 11–16 are gas-tighly melt-sealed between two hollow quartz glass tubes, which form the neck portions 3, 4 of the discharge vessel. The finished necks 3, 4 are formed with a central opening or bore 17, 18 reaching up to and close to the molybdenum disks 7, 8; the other end of the opening or bore 17, 18 terminates in the respective base 9, 10, which is formed with openings, not visible in FIG. 1, to permit air convection into and through the interior of the necks 3, 4.

It is also possible to provide a rod 26 (FIG. 1) of heat-conductive material within the neck, located close to the free end thereof. It is insulated from the current carrying foils and conducting leads to the base terminal. It extends into the hollow cylindrical opening of the neck to provide additional heat conduction off the neck region.

Figure 2:
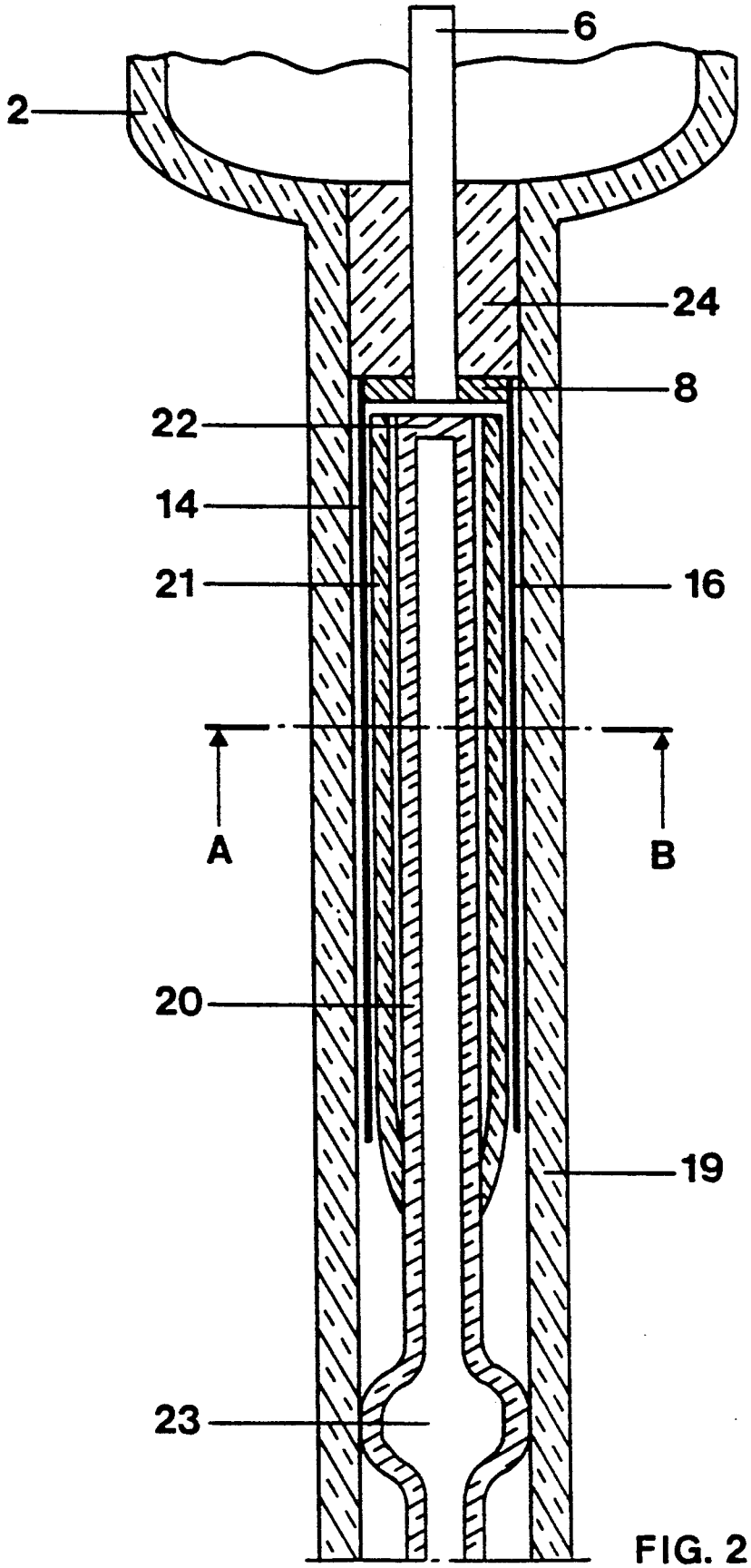
FIG. 2 is a longitudinal sectional view, to an enlarged scale, through the neck portion of the discharge tube before the sealing foils have been melt-sealed, and the entire neck structure has been melt-sealed together.
Figure 3:
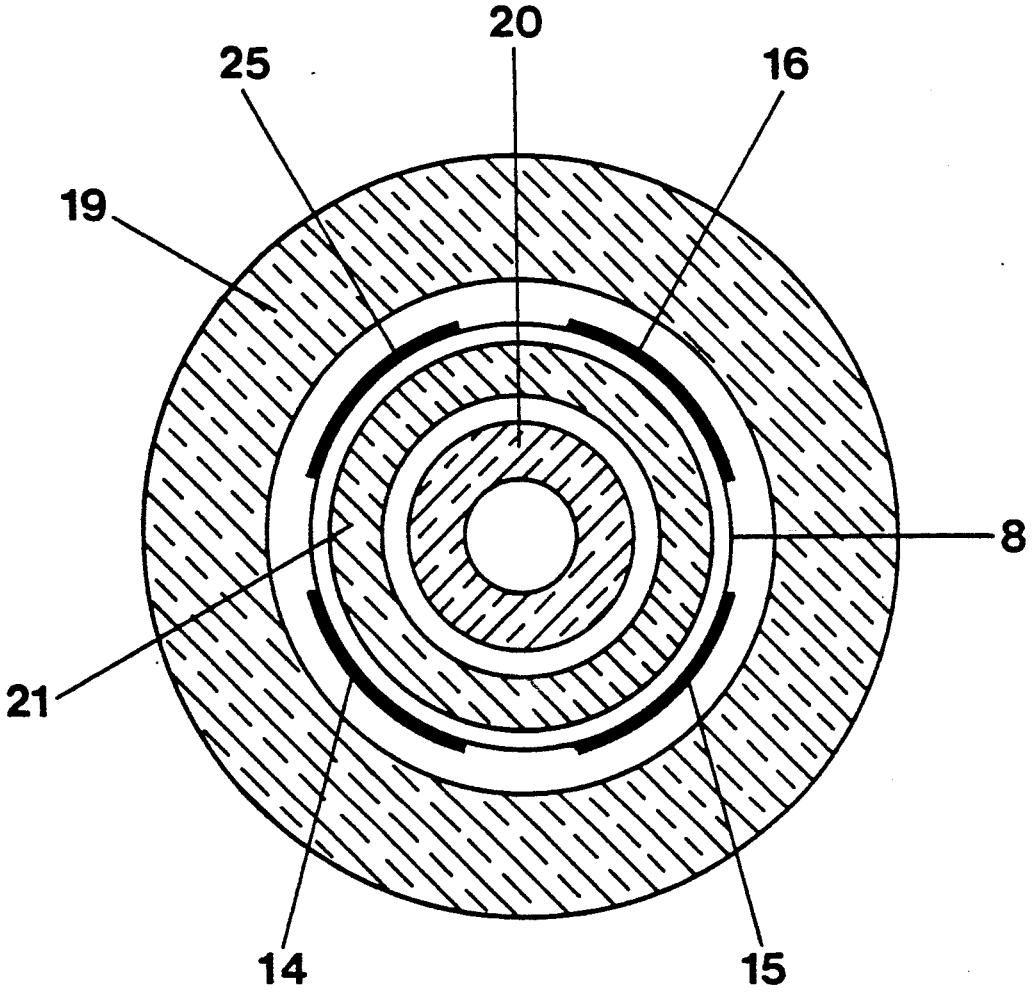
FIG. 3 is a cross section through the lamp neck along the section line A-B and before the neck structure has been melt-sealed together.

The construction of the neck is best seen by reference to FIGS. 2 and 3, in which the figures illustrate the neck before it is melt-sealed together. The neck has a hollow cylindrical outer neck tube 19, melt-sealed to the rotation-symmetrical discharge vessel 2. A hollow cylindrical inner tube 27 made of quartz glass is fitted within the neck tube 19. This hollow cylindircal inner tube 27 is formed of two telecoped tubes 21, 20. The hollow cylindrical inner tube 27, thus, is a composite structure. The innermost tube 20 of the two telescoped tubes 21, 20 is sealed off at its end facing the discharge chamber 2 with a seal 22. At the remote end, facing the base, it is formed with a ring-shaped extension bulge 23, which has an outer diameter just meeting the inner walls of the outer quartz glass tube 19, so that the ring 23 and the tube 19 touch. The outer quartz tube 21 of the inner tube structure is open towards the discharge space 2; at its other end, close to the ring-shaped expansion 23, it is melt-connected to the inner quartz tube 22.

A disk 8 of molybdenum is placed on the end of the two telescoped tubes 20, 21. The tungsten electrode 6 is connected to the disk 8, for example by being soldered thereto with platinum solder, or fitted into a hole in the disk 8 and then soldered to the disk 8. The disk 8, at its circumference, carries the four sealing foils, of which only foils 14, 16 are visible in FIG. 2. They are welded to the disk 8.

The sealing foils 14, 16 extend parallel to the axis of the neck and are positioned between the tube 19 of the neck and the outer tube 21 of the composite inner tube structure 27, that is, tubes 21, 20. Additionally, a hollow cylindrical quartz glass tube 24 is fitted around the shaft of the electrode 6 above the molybdenum disk 8, which is provided to form a seal between the discharge space 2 and the molybdenum disk 8 upon melt-sealing the entire structure.

FIG. 3 clearly illustrates the position of the respective tubes and of four strip or ribbon or tape sealing foils 14, 15, 16, 25. The outer tube 19 and the composite hollow cylindrical inner tube structure formed of inner tubes 20, 21 is clearly seen. A portion of the molybdenum disk 8 likewise can be seen.

The free end of the electrode shaft can be butt or end-soldered to the molybdenum disk 8 or, if desired, first fitted into a suitable opening and then soldered to the disk, by platinum solder material.

To manufacture the lamp, first the outer quartz glass tube 19 is melted onto the hollow cylindrical discharge space, which is formed with axially aligned openings. A subassembly is then made, formed of the disk 8, the electrode 6 connected thereto, and the sealing foils welded to the disk 8. The subassembly of the electrode with the disk 8 and the sealing foils is then seated on the composite inner tube 21, 20, and the quartz glass cylinder or tube 24 placed around the shaft 6. The thus formed subassembly is then introduced into the neck 3, by pushing it into the outer quartz tube 19. The enlargement 23 is then melt-sealed to the outer tube 19, and a flushing gas, typically argon, is then introduced through the still unsealed tip-off opening 2' (FIG. 1) of the discharge vessel. After repeated flushing, the space between the outer tube 19 and the outermost tube 21 of the composite tube 27 is evacuated and, after evacuation, the sealing foils are melt-sealed gas-tightly between the tube 19 and the composite formed by tubes 20, 21. In the space between the tubes 19 and the composite formed by tubes 20, 21, a vacuum of 20 mbar argon is maintained. The interior of the innermost one of the composite tubes, that is of tube 20, can have an air pressure of 1 bar applied. Upon melt-sealing, the quality of the seal and of the composite tube 27 can be checked, and appropriate heating of the composite inner tube 27 determined when, optically, no further outer contours of the individual tubes 20,21 are visible. In FIGS. 2 and 3, the reference numeral 27 indicates the composite formed by the individual tubes 20, 21 before the sealing step has been carried out.

After melt-sealing, the portion of the inner tube 27 or inner tube combination above the ring expansion 23 is severed, providing access to the foils for further connection to a base terminal. The lamp can then be filled with a desired fill and thereafter tipped off at the pumping tip 2'. A suitable fill includes a noble gas and, optionally, additives of mercury, and metal halides.

The table, forming part of this specification, gives data for the 24 kW lamp with a metal halide filling.

Various changes and modifications may be made, and any features described herein may be used with any of the others, within the scope of the inventive concept.

TABLE

| | |
|---|---|
| lamp power | 24 000 W |
| lamp voltage | 225 V |

TABLE-continued

| | |
|---|---|
| lamp current | 125 A |
| light flux | above 2 mega lumens |
| volume of discharge vessel 2 | 50 $cm^3$ |
| arc length | 45 mm |
| color temperature | 6 000 K. |
| overall length | max. 600 cm |
| average lifetime | 200 h |
| width of the foils in tape, ribbon or strip form: | 10 mm |
| thickness of the tape, ribbon or strip foils: | 50 μm |
| length of the tape, ribbon or strip foils within the melt region of the neck of the lamp: | 16 cm |
| inner diameter of quartz tube 19 before sealing: | 19 mm |
| inner diameter of composite inner quartz tube 27 before sealing: | 16 mm |
| wall thickness of quartz tube 19: | 2.5 mm |
| wall thickness of composite quartz tubes 27, i.e. tubes 20, 21: | 3 mm |

We claim:

1. A double-based high-pressure discharge lamp capable of carrying lamp currents of above 20 amperes having a discharge vessel (2) of quartz glass having a generally rotation-symmetrical discharge space therein;

two hollow lamp necks (3, 4) extending coaxially from opposite ends of the essentially rotation-symmetrical discharge vessel (2) and melt-sealed to said discharge vessel;

two electrodes (5, 6), each having an electrode shaft located partly within the discharge space and having a shaft portion extending into the respective neck (3, 4); and a fill including a noble gas and, optionally, mercury and metal halides, comprising a combined high current carrying electrical current connection, heat removal, and electrode sealing arrangement for each of the electrodes (5, 6) wherein each of said arrangements includes a single metal, disk (7, 8), located within the respective neck (19), spaced from the discharge vessel (2), and secured to the respective shaft portion, whereby said lamp will have two metal disks;

at least one sealing foil (11–16, 25) secured to the respective metal disk, extending longitudinally within the respective neck and electrically and mechanically secured to the respective disk, whereby said lamp will have at least two sealing foils; and wherein each one of said necks comprises a composite neck structure including at least two hollow cylindrical quartz glass tubes (19, 27; 20, 21) concentrically telescopically located with respect to each other to define a neck tube (19), and an inner tube (27; 20, 21), said at least one respective sealing foil being positioned between two (19; 27) of said quartz glass tubes; and wherein said telescopically located quartz glass tubes (19, 27; 20, 21) with the sealing foils (11–16, 25) therebetween are gas-tightly melt-sealed together while leaving a hollow interior space interiorly of the inner glass tube (27; 20).

2. The lamp of claim 1, wherein four sealing foils (11–16, 25) are connected to each one of said metal disks, circularly located thereon, and spaced from each other, said four sealing foils being located between said telescopically located quartz glass tubes of each of said necks.

3. The lamp of claim 1, wherein said at least one sealing foil (11–16, 25) is in tape, ribbon or strip form.

4. The lamp of claim 2, wherein said sealing foils are uniformly spaced about the circumference of the inner one (27; 21, 20) of the telescopically arranged quartz glass tubes (19, 27; 20, 21), and extend essentially parallel to the longitudinal axis of the respective neck.

5. The lamp of claim 1, wherein each of said disks (7, 8) is cylindrical.

6. The lamp of claim 1, wherein the shaft portion of each of the electrodes (5, 6) is butt-soldered to the respective disk (7, 8).

7. The lamp of claim 1, wherein each of said disks (7, 8) is formed with a circular opening therethrough; and said shaft portions have circular cross section, are fitted in an opening of the respective disk, and soldered to the respective disk.

8. The lamp of claim 1, wherein the telescopically located inner one (27; 20, 21) of the hollow cylindrical quartz glass tubes (19, 27; 20, 21) is closed at the end (22) thereof facing the discharge space (2).

9. The lamp of claim 1, further including a rod or pin element (26) comprising heat conductive material located within the inner one (27) of the telescopically located glass tubes, and extending within the hollow interior space thereof to form a heat conducting element, insulated with respect to said foils.

10. The lamp of claim 1, wherein each of said metal disks (7, 8) comprise molybdenum.

11. The lamp of claim 1, wherein said composite neck structure comprises three telescopically positioned tubes, comprising an innermost tube (20) and an intermediate tube (21) located between the neck tube (19) and the innermost tube (20), said neck tube (19) forming the outer portion of the respective neck;

and wherein said innermost tube (20) and said intermediate tube (21) are melt-sealed together and form a composite inner tube (27) of said composite neck structure.

12. A method to make a high-pressure discharge lamp, wherein said lamp comprises a discharge vessel (2) of quartz glass having a generally rotation-symmetrical discharge space therein;

two hollow lamp necks (3, 4) extending coaxially from opposite ends of the essentially rotation-symmetrical discharge vessel (2) and melt-sealed to said discharge vessel;

two electrodes (5, 6), each having an electrode shaft located partly within the discharge space and having a shaft portion extending into the respective neck (3, 4); and a fill including a noble gas and, optionally, mercury and metal halides, comprising a combined high current carrying electrical current connection, heat removal, and electrode sealing arrangement for each of the electrodes (5, 6) wherein each of said arrangements includes a single metal disk (7, 8), located within the respective neck (19), spaced from the discharge vessel (2), and secured to the respective shaft portion, whereby said lamp will have two metal disks;

at least one sealing foil (11–16, 25) secured to the respective metal disk, extending longitudinally within the respective neck and electrically and mechanically secured to the respective disk, whereby said lamp will have at least two sealing foils; and wherein each one of said necks comprises a composite neck structure including at least two hollow cylindrical quartz glass tubes (19, 27; 20, 21) concentrically telescopically located with respect to each other to define a neck tube (19), and an inner tube (27; 20, 21), said at least one respective sealing foil being positioned between two (19; 27) of said quartz glass tubes; and wherein said telescopically located quartz glass tubes (19, 27; 20, 21) with the sealing foils (11–16, 25) therebetween are gas-tightly melt-sealed together while leaving a hollow interior space interiorly of the inner glass tube (27; 20);

said method comprising providing said quartz glass, generally rotation-symmetrical discharge vessel, having openings located at opposite axial ends thereof;

melt-sealing a hollow or tubular cylindrical neck tube (19) of quartz glass to said discharge vessel at said opposite axial ends; and wherein the inner openings of said neck tubes (19) are in alignment with said axial openings in the essentially rotation-symmetrical discharge vessel.

13. The method of claim 12, including the step of securing the end portion of each electrode shaft to a respective one, each, of said metal disks (7, 8) in such a manner that the respective electrode shaft extends from a face surface of the respective metal disk.

14. The method of claim 13, including the step of fitting the electrode shaft portion, with the respective metal disk (7, 8) and the at least two sealing foils, over a hollow cylindrical inner quartz glass tube (27) which is closed off at the end thereof facing said disk to form said inner tube (27) of the lamp, said inner tube being closed off at the end thereof facing said disk;

and wherein said inner tube (27), in a region remote from said closed-off end, is formed with a circumferential or ring-shaped or barrel or olive-shaped expansion or distention (23) having an outer diameter fitting within the inner wall of the outer neck tube (19).

15. The method of claim 14, wherein said inner glass tube comprises a composite glass tube element (27) formed of two telescoped glass tubes (20, 21) defining an innermost (20) and an intermediate (21) glass tube element; and melt-sealing the innermost (20) and intermediate (21) glass tube elements together in the vicinity of said barrel or olive-shaped expansion or distention (23).

16. The method of claim 14, further comprising the step of melt-sealing said barrel-shaped or olive-shaped expansion or distention (23) to the inner wall of said neck tube (19).

17. The method of claim 16, further including the step flushing the space between the inner wall of the neck tube (19) and said inner tube (27; 20, 21) with a flushing gas, optionally argon.

18. The method of claim 17, further comprising the steps of evacuating the space between the neck tube (19) and the inner tube (27; 20, 21); and melt-sealing the sealing foils (11–16, 25) positioned between the inner tube and the neck tube (19) gas-tightly between the inner tube (27) and the neck tube (19).

19. The method of claim 18, wherein said step of melt-sealing the inner (27) and neck (19) tubes, with the sealing foils therebetween, is carried out under a vacuum of 20 mbar argon, and with the interior hollow space of the hollow cylindrical inner tube (27; 21) being subjected to air pressure of 1 bar.

20. The method of claim 19, further including the step of severing the free end of the neck tube (19) together with the barrel or olive-shaped expansion or distention (23) of the inner tube (27; 20, 21).

* * * * *